US006198367B1

(12) United States Patent
Matsunaga et al.

(10) Patent No.: US 6,198,367 B1
(45) Date of Patent: Mar. 6, 2001

(54) HIGH-FREQUENCY CIRCUIT ON A SINGLE-CRYSTAL DIELECTRIC SUBSTRATE WITH A THROUGH HOLE IN A DIFFERENT SUBSTRATE

(75) Inventors: Yoshinori Matsunaga; Tsuyoshi Nakai, both of Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/261,815

(22) Filed: Mar. 3, 1999

(30) Foreign Application Priority Data

Mar. 6, 1998 (JP) ..... 10-055122

(51) Int. Cl.[7] ..... H01P 3/08
(52) U.S. Cl. ..... 333/246; 333/260; 333/99 S
(58) Field of Search ..... 333/34, 35, 33, 333/99 S, 204, 246, 260

(56) References Cited

U.S. PATENT DOCUMENTS 2,938,175 * 5/1960 Sommers et al. ..... 333/33
4,208,642 * 6/1980 Saunders ..... 333/246
5,270,672 * 12/1993 Schinzel ..... 333/245

OTHER PUBLICATIONS

Lehrfeld, "What If You Don't Use Alumina?", Microwaves, pp. 54–56, Mar. 1971.*

* cited by examiner

*Primary Examiner*—Justin P. Bettendorf
(74) *Attorney, Agent, or Firm*—Hogan & Hartson, LLP

(57) ABSTRACT

It has been difficult to form a high-frequency electronic circuit using a single-crystal dielectric substrate, and down-sizing of high-frequency electronic circuits is also difficult because of necessity of a metal housing. A high-frequency electronic device comprises a single-crystal dielectric substrate provided with a first ground conductor layer and a first wiring conductor layer constituting a high-frequency electronic circuit, a first dielectric substrate provided with a second ground conductor layer, the single-crystal dielectric substrate and the first dielectric substrate being made into contact with each other so that the top faces thereof form substantially the same plane, and a second dielectric substrate provided with a third ground conductor layer, the second dielectric substrate being attached to the top faces of the single-crystal dielectric substrate and the first dielectric substrate, wherein the first ground conductor layer is electrically connected with the second and third ground conductor layers, and the first wiring conductor layer is electrically connected with a second wiring conductor layer formed on the second dielectric substrate, and electrically connected with an external electric circuit via a second through conductor. A high-frequency electronic circuit excellent in characteristics can be obtained, and the down-sizing can be realized by eliminating a metal housing.

18 Claims, 8 Drawing Sheets

HIGH-FREQUENCY CIRCUIT ON A SINGLE-CRYSTAL DIELECTRIC SUBSTRATE WITH A THROUGH HOLE IN A DIFFERENT SUBSTRATE

BACKGROUND OF THE INVENTION

1. Field of the Invention

The present invention relates to a high-frequency electronic device in which a high-frequency electronic circuit constituted by a line conductor is fabricated on a single-crystal dielectric substrate.

2. Description of the Related Art

A high-frequency electronic device in which a high-frequency electronic circuit constituted by a line conductor made of a thin-film conductor layer is fabricated on a single-crystal dielectric substrate, which device is used as a high-frequency component in a high-frequency electronic apparatus, has such a structure as shown by an exploded perspective view of FIG. 5A and a sectional view of FIG. 5B conventionally.

In FIGS. 5A and 5B, a high-frequency electronic circuit 2 constituted by a wiring conductor layer of a line conductor or the like is formed on the top face of a single-crystal dielectric substrate 1, and a ground conductor layer (ground plane) 3 is formed on the same face as or the opposite face to the high-frequency electronic circuit 2. This single-crystal dielectric substrate 1 is installed in a metal housing 4 and covered with a metal lid 5 which is attached to the top face of the metal housing 4, thereby hermetically stored in a container which is constructed of the metal housing 4 and the metal lid 5. Input and output of electric signals between the high-frequency electronic circuit 2 in the metal housing 4 and an outside is carried out via a connector 6 which is built in a side wall of the metal housing 4.

With regard to a wiring conductor layer which constitutes the high-frequency electronic circuit 2, other than a microstrip line structure of placing a line conductor on the top face of the single-crystal dielectric substrate 1 and placing the ground conductor layer 3 on the bottom face thereof as shown in FIGS. 5A and 5B, a coplanar line structure of placing a line conductor and a ground conductor layer so as to be parallel to the line conductor on the top face of a dielectric substrate, has been used. In these cases, an electromagnetic wave is radiated from the high-frequency electronic circuit 2 of the microstrip line structure or the coplanar line structure into the upper space of the line conductor formed on the single-crystal dielectric substrate 1, and such radiation of an electromagnetic wave causes degradation of the performance of the high-frequency electronic circuit 2 and an adverse effect on an external electronic circuit, so that it is necessary to make the high-frequency electronic circuit 2 have a structure of trapping an electromagnetic wave by a conductive member. For this reason, conventionally, a shield structure of covering the high-frequency electronic circuit 2 with the metal housing 4 and the metal lid 5 is adopted, whereby an electromagnetic wave is prevented from being radiated to the outside of the electronic device.

In such a conventional high-frequency electronic device, the high-frequency electronic circuit 2 is constituted by a line conductor of the microstrip line structure or the coplanar line structure as described above, and a line conductor of a strip line structure is not used, in which ground planes are respectively placed on the top and bottom faces of a dielectric substrate and a line conductor is formed as an internal wiring layer within the dielectric substrate interposed between these ground planes. The reason is that in the strip line structure, while it is necessary to dispose a through conductor for connecting the internal wiring layer with the signal line of an external circuit, in the case of using the single-crystal dielectric substrate as a dielectric substrate in order to cause a conductive material which constitutes the internal wiring layer to reach an orientational growth or a single-crystal growth, improve the flow of electricity, and reduce loss at the internal wiring layer, it has been impossible to produce the through conductor on a single-crystal dielectric substrate.

That is to say, a single-crystal dielectric substrate is produced by recrystallizing a raw material which is once fused, and hence it is impossible to process a through hole for disposing a through conductor in the producing step, so that there has been a problem that a line conductor which is formed inside the dielectric substrate cannot be connected with an external circuit via a through conductor.

Moreover, although it is possible to open a through hole on a single-crystal dielectric substrate by using a drill and the like, there has been a problem that the crystal structure around the through hole is disturbed when the through hole is thus opened, with the result that the line conductor cannot reach an orientational growth or a single-crystal growth in an excellent manner.

For these reasons, the strip line structure which hardly brings an adverse effect on the high-frequency electronic circuit and has excellent electric characteristics because the electromagnetic radiation coming from the line conductor is shielded down by the ground planes placed thereon and thereunder, has not been adopted in the conventional high-frequency electronic device.

On the other hand, in a configuration of the conventional microstrip line structure or coplanar line structure as described above, an electronic circuit 2 is covered with a metal housing 4 and a metal lid S in order to prevent electromagnetic radiation, and the metal housing 4 is big and heavy, so that there has been a problem that it is difficult to reduce the size and weight of a high-frequency circuit component. Besides, the upper space of the line conductor of the microstrip line structure or the coplanar line structure is hollow inside a container which is constructed of the metal housing 4 and the metal lid 5, and hence the efficiency of dissipating heat which is generated from the line conductor is low, so that there has also been a problem that the high-frequency electronic circuit is degraded in electric characteristics due to elevation in temperature or generation of a temperature distribution therein.

SUMMARY OF THE INVENTION

The present invention has been proposed in view of the aforementioned circumstances, and an object of the invention is to provide a high-frequency electronic device which realizes reduction in size and weight without the use of a metal housing while preventing electromagnetic radiation coming from a line conductor which adversely affects a high-frequency electronic circuit fabricated thereon.

In a first aspect of the invention a high-frequency electronic device of the invention comprises:

- a single-crystal dielectric substrate on a bottom face of which a first ground conductor layer is formed to adhere thereto, and on a top face of which a first wiring conductor layer constituting a high-frequency electronic circuit is formed to adhere thereto;
- a first dielectric substrate on a bottom face of which a second ground conductor layer is formed to adhere thereto, the first dielectric substrate being made into contact with the single-crystal dielectric substrate so that a top face of the first dielectric substrate forms substantially the same plane with the top face of the single-crystal dielectric substrate and a second dielectric substrate on a top face of which a third ground conductor layer is formed to adhere thereto, the second dielectric substrate being attached to the top faces of the single-crystal dielectric substrate and the first dielectric substrate so as to cover the top face of the single-crystal dielectric substrate wherein the first ground conductor layer is electrically connected with the second ground conductor layer and also electrically connected with the third ground conductor layer via a first through conductor which passes through the first dielectric substrate and the second dielectric substrate and wherein the first wiring conductor layer electrically connected with a second wiring conductor layer which is formed on the top face of the first dielectric substrate or the bottom face of the second dielectric substrate to adhere thereto, and also electrically connected with an external electric circuit via a second through conductor which is placed so as to pass through the first dielectric substrate or the second dielectric substrate and which is electrically connected with the second wiring conductor layer.

Further, in a second aspect of the invention the high-frequency electronic device with the above configuration is characterized in that the second wiring conductor layer constitutes an impedance transformer for matching in characteristic impedance the first wiring conductor layer to an external electric circuit connected with the second through conductor.

In a third aspect of the invention a high-frequency electronic device comprises:

(a) a single-crystal dielectric substrate having a first ground conductor layer which is formed on one surface thereof and a first wiring conductor layer which is formed on the other surface thereof to constitute a high-frequency electronic circuit;

(b) a first dielectric substrate abutting against the single-crystal dielectric substrate so as to be next to each other, the first dielectric substrate having a second ground conductor layer which is formed on one surface thereof and electrically connected with the first ground conductor layer, the other surface of the first dielectric layer forming substantially the same plane with the other surface of the single-crystal dielectric substrate;

(c) a second dielectric substrate having a third ground conductor layer which is formed on one surface thereof and a second wiring conductor which is formed on the other surface thereof and electrically connected with the first wiring conductor layer, the second dielectric substrate being attached to the other surface of the single-crystal dielectric substrate and the other surface of the first dielectric substrate so as to cover the other surface of the single-crystal dielectric substrate;

(d) a first through conductor passing through the first dielectric substrate and the second dielectric substrate, for electrically connecting the second ground conductor layer with the third ground conductor layer; and (e) a second through conductor passing through the second dielectric substrate and being electrically connected with the second wiring conductor layer to be electrically connected with an external electric circuit.

In a fourth aspect of the invention a high-frequency electronic device comprises:

(a) a single-crystal dielectric substrate having a first ground conductor layer which is formed on one surface thereof and a first wiring conductor layer which is formed on the other surface thereof to constitute a high-frequency electronic circuit;

(b) a first dielectric substrate abutting against the single-crystal dielectric substrate so as to be next to each other, the first dielectric substrate having a second ground conductor layer which is formed on one surface thereof and electrically connected with the first ground conductor layer, the other surface of the first dielectric substrate forming substantially the same plane with the other surface of the single-crystal dielectric substrate, the first dielectric substrate further having a second wiring conductor layer which is formed on the other surface of this first dielectric substrate;

(c) a second dielectric substrate having a third ground conductor layer which is formed on one surface thereof, the second dielectric substrate being attached to the other surface of the single-crystal dielectric substrate and the other surface of the first dielectric substrate so as to cover the other surface of the single-crystal dielectric substrate 31;

(d) a first through conductor passing through the first dielectric substrate and the second dielectric substrate, for electrically connecting the second ground conductor layer with the third ground conductor layer; and (e) a second through conductor passing through the first dielectric substrate, being electrically connected with the second wiring conductor layer to be electrically connected with an external electric circuit.

In a fifth aspect of the invention a high-frequency electronic device comprises:

(a) a first ground plane single-crystal substrate on one surface of which a first ground conductor layer is formed;

(b) a single-crystal dielectric substrate, one surface thereof facing the first ground conductor layer, the single-crystal dielectric substrate having a first wiring conductor layer which is formed on the other surface thereof to constitute a high-frequency electronic circuit;

(c) a first dielectric substrate abutting against the single-crystal dielectric substrate so as to be next to each other, the first dielectric substrate having a second ground conductor layer which is formed on one surface thereof and electrically connected with the first ground conductor layer, the other surface of the first dielectric substrate forming substantially the same plane with the other surface of the single-crystal dielectric substrate;

(d) a second dielectric substrate having a third ground conductor layer which is formed in a region corresponding to the first dielectric substrate of one surface thereof, and a second wiring conductor layer which is formed on the other surface thereof and electrically connected with the first wiring conductor layer, the second dielectric substrate being attached to the other surface of the single-crystal dielectric substrate and the other surface of the first dielectric substrate so as to cover the other surface of the single-crystal dielectric substrate,;

(e) a second ground plane single-crystal substrate having another third ground conductor layer which is formed in a region corresponding to the single-crystal dielectric substrate of a surface on the-second dielectric substrate side and electrically connected with the third ground conductor layer;

(f) a first through conductor passing through the first dielectric substrate and the second dielectric substrate for electrically connecting the second ground conductor layer with the third ground conductor layer; and (g) a second through conductor passing through the second dielectric substrate, being electrically connected with the second wiring conductor layer to be electrically connected with an external electric circuit.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
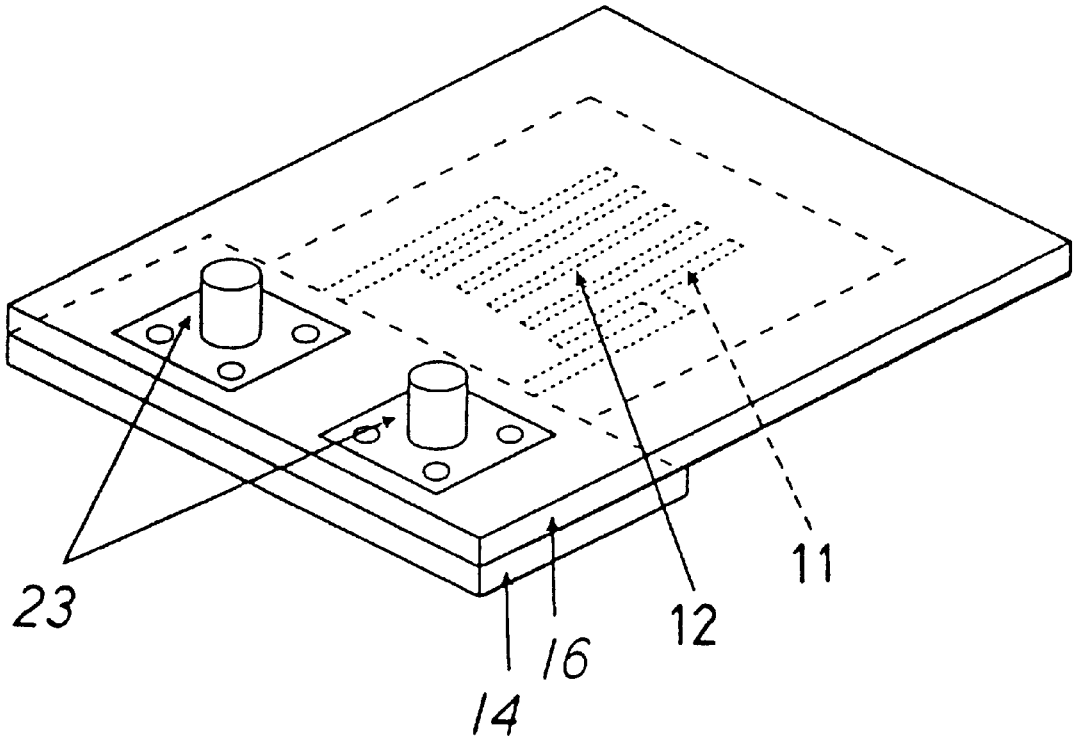
FIG. 1A is a perspective view showing an embodiment of a high-frequency electronic device of the invention.

As described above, according to the high-frequency electronic device of the invention, a strip line structure is completed in such a manner that a first wiring conductor layer 12, 32, 52 which is formed on the top face of a single-crystal dielectric substrate 11, 31, 51 to adhere thereto to constitute a high-frequency electronic circuit is interposed via dielectric substrates between the ground planes of the two layers of the first ground conductor layer 13, 33, 53 which adheres to the bottom face of the single-crystal dielectric substrate 11, 31, 51, and a third ground conductor layer 17, 37, 57*a*, 57*b* which adheres to the top face of a second dielectric substrate 16, 36, 56 attached to the top face of the single-crystal dielectric substrate 11, 31, 51, with the result that it is not necessary to use a metal housing as the conventional high-frequency electronic device, and it is possible to prevent electromagnetic radiation coming from a high-frequency electronic circuit and reduce the size and weight.

Moreover, since around the first wiring conductor layer 12, 32, 52 constituting the high-frequency electronic circuit can be eliminated an extra space such as a hollow which is present in the conventional metal housing can be eliminated, it is possible to easily and efficiently dissipate heat generated in the high-frequency electronic circuit and realize a stable operation.

Furthermore, according to the high-frequency electronic device of the invention, since the first wiring conductor layer 12, 32, 52 constituting the high-frequency electronic circuit on the single-crystal dielectric substrate 11, 31, 51 is electrically connected with an external electric circuit via the second wiring conductor layer 40, 20, 60 which is electrically connected with this first wiring conductor layer 12, 32, 52 and via the second through conductor 42, 22, 62 which is electrically connected with the second wiring conductor layer 40, 20, 60, it is not necessary to dispose a through conductor for connecting with the external electric circuit to the single-crystal dielectric substrate 11, 31, 51. Therefore, it is possible to use the single-crystal dielectric substrate 11, 31, 51 to construct a high-frequency electronic circuit of the strip line structure having excellent electric characteristics, and it is possible to prevent electromagnetic radiation coming from the high-frequency electronic circuit and reduce the size and weight.

In addition, according to the high-frequency electronic device of the invention, in the case where an impedance transformer for matching in characteristic impedance the first wiring conductor layer 12, 32, 52 to the external electric circuit which is connected with the second through conductor 40, 20, 60 is constituted by the second wiring conductor layer 40, 20, 60, it is not necessary to match the characteristic impedance of the first wiring conductor layer 12, 32, 52 to a general characteristic impedance such as 50 Ω and 75 Ω, and therefore the degree of freedom for designing the first wiring conductor layer 12, 32, 52 is enhanced, which achieves a low-loss first wiring conductor layer and a high-density wiring.

According to the high-frequency electronic device of the invention, a strip line structure is completed in such a manner that the first wiring conductor layer 12, 32, 52 formed on the top face of the single-crystal dielectric substrate 11, 31, 51 to constitute the high-frequency electronic circuit is interposed via the dielectric substrates between the ground planes of the two layers of the first ground conductor layer 13, 33, 53 formed on the bottom face of the single-crystal dielectric substrate 11, 31, 51 and the third ground conductor layer 17, 37, 57*a*, 57*b* formed on the top face of the second dielectric substrate 16, 36, 56 attached to the top face of the single-crystal dielectric substrate 11, 31, 51, with the result that the electromagnetic radiation of high-frequency signals propagating through the first wiring conductor layer 12, 32, 52 is restricted in the dielectric substrates formed between the first ground conductor layer 13, 33, 53 and the third conductor layer 17, 37, 57*a*, 57*b*. Therefore, it is not necessary to use a metal housing as in the conventional high-frequency electronic device in which a high-frequency electronic circuit of the microstrip line structure or the coplanar line structure is mounted, and hence a high-frequency electronic device which realizes reduction in size and weight while preventing electromagnetic radiation coming from the high-frequency electronic circuit can be attained.

Moreover, since around the first wiring conductor layer 12, 32, 52 constituting the high-frequency electronic circuit can be eliminated an extra space such as a hollow which is present in the conventional metal housing, it is also possible to easily and efficiently dissipate heat generated in the high-frequency electronic circuit.

Furthermore, according to the high-frequency electronic device of the invention, the first wiring conductor layer 12, 32, 52 constituting the high-frequency electronic circuit on the single-crystal dielectric substrate 11, 31, 51 is electrically connected with an external electric circuit in such a manner that the first wiring conductor layer 12, 32, 52 is electrically connected with the second wiring conductor layer 40, 20, 60 formed on the top face (FIG. 3A) of the first dielectric substrate 34 or the bottom face (FIGS. 1 and 4A) of the second dielectric substrate 16, 56 attached to the single-crystal dielectric substrate 11, 31, 51, and furthermore, electrically connected via the second through conductor 42, 22, 62 which is placed so as to pass through the first dielectric substrate 34 (FIG. 3A) or the second dielectric substrate 16, 56 (FIGS. 1 and 4A) and which is electrically connected with the second wiring conductor layer 40, 20, 60. Therefore, it is not necessary to dispose a through conductor for connecting with the external electric circuit to the single-crystal dielectric substrate 11, 31, 51, and hence it is possible to construct a high-frequency electronic circuit of the strip line structure on the single-crystal dielectric substrate 11, 31, 51 without opening a through hole on the single-crystal dielectric substrate 11, 31, 51. As a result, it is possible to accomplish a high-frequency electronic device which realizes reduction in size and weight while preventing electromagnetic radiation coming from the high-frequency electronic circuit.

In addition, according to the high-frequency electronic device of the invention, in the case where the second wiring conductor layer 20, 40, 60 for electrically connecting the first wiring conductor layer 12, 32, 52 constituting the high-frequency electronic circuit on the single-crystal dielectric substrate 11, 31, 51 with the second through conductor 22, 42, 62 for connecting with an external electric circuit constitutes an impedance transformer for matching in characteristic impedance the first wiring conductor layer 12, 32, 52 to the external electric circuit connected with the second through conductor 22, 42, 62, it is not necessary to match the characteristic impedance of the first wiring conductor layer 12, 32, 52 formed on the single-crystal dielectric substrate 11, 31, 51 to a general characteristic impedance such as 50 Ω and 75 Ω of an external electric circuit or a coaxial cable which is preferably used for connecting the second through conductor 22, 42, 62 and an external electric circuit As a result, the degree of freedom for designing the first wiring conductor layer 12, 32, 52 is enhanced, and in the case where the first wiring conductor layer 12, 32, 52 is designed to have a small characteristic impedance, it is possible to increase the wiring width of the first wiring conductor layer 12, 32, 52 to construct a low-loss high-frequency electronic circuit. Moreover, in the case where the fist wiring conductor layer is designed to have a large characteristic impedance, the wiring width thereof becomes small, and it is possible to make a high-density wiring in which the loss of high-frequency signals is increased.

As such an impedance transformer, it is desirable to use a distributed constant circuit which is used for high-frequency circuits and formed of a thin film, and accordingly it is preferable to use a quarter-wavelength-type or taper-type impedance transformer.

The quarter-wavelength-type impedance transformer is such that two line conductors having different line widths and characteristic impedances Za and Zb, respectively, are connected by a line conductor having a line width which is changed stepwise by a length corresponding to a quarter of the wavelength of high-frequency signals and has a characteristic impedance Zb defined by $Zb=(Za\times Zb)^{1/2}$ so that the high-frequency signals do not reflect. On the other hand, the taper-type impedance transformer is such that two line conductors having different line widths and characteristic impedances Za and Zb are connected by a line conductor having a line width which is changed continuously so that the high-frequency signals do not reflect.

As the impedance transformer constituted by the second wiring conductor layer 20, 40, 60 of the invention, may be used any ones in addition to these quarter-wavelength-type or taper-type ones, as long as the reflection of high-frequency signals is small at the time of coupling line conductors different in characteristic impedance from each other, for example, a circuit of a coil or capacitor which is an equivalent circuit designed by a lumped constant circuit to show the same performance as that of the quarter-wavelength-type one, and it is possible to branch a circuit to decrease the impedance of the wiring.

Further, according to the high-frequency electronic device of the invention, the first wiring conductor layer 12, 32, 52 formed on the single-crystal dielectric substrate 11, 31, 51 is electrically connected with the second wiring conductor layer 20, 40, 60 formed on the first dielectric substrate 14, 34, 54 or the second dielectric substrate 16, 36, 56 which are other single-crystal dielectric substrates or non-single-crystal dielectric substrates, so that a variety of complicated high-frequency electronic circuits can be constructed and the high-frequency electronic device can be improved in electric characteristics. Furthermore, the single-crystal dielectric substrate 11, 31, 51 and the first and second dielectric substrates 14, 34, 54; 16, 36 ,56 are entirely or partially made to have different dielectric constants or made to have small dielectric loss, whereby it is possible to partially change the first and second wiring conductor layers 12, 32, 52; 20, 40, 60 in characteristic impedance and decrease the loss of the wiring conductor layers, and it is possible to enhance the degree of freedom in designing the high-frequency electronic circuit constituted by the first wiring conductor layer 12, 32, 52 or by the first wiring conductor layer 12, 32, 52 and the second conductor layer 20, 40, 60.

In the high-frequency electronic device of the invention, a wiring conductor layer for constituting the high-frequency electronic circuit may be formed on the bottom face of the second dielectric substrate 16, 36, 56 which faces the top face of the single-crystal dielectric substrate 11, 31, 51 provided with the first wiring conductor layer 12, 32, 52, and in the case where the wiring conductor layer is electrically connected with the first wiring conductor layer 12, 32, 52 and the second wiring conductor layer 20, 40, 60, it is possible to construct a more complicated high-frequency electronic circuit and it is possible to improve the high-frequency electronic device in electric characteristics.

Further, according to the high-frequency electronic device of the invention, since the first wiring conductor layer 12, 32, 52 and an external electric circuit are electrically connected with each other via the second through conductor 22, 42, 62, by connecting a coaxial cable connector or a coaxial cable with a lead-out end of the second through conductor 42, 22, 62 on the bottom face of the first dielectric substrate 34 or the top face of the second dielectric substrate 16, 56, it is possible to place them at arbitrary positions on the bottom face of the first dielectric substrate 34 or the top face of the second dielectric substrate 16, 56 and connect the ground conductor of the coaxial cable connector or the coaxial cable with the second ground conductor layer 35 or the third ground conductor layer 17, 57*a*, 57*b* in a simple and low-loss manner. Therefore, it is possible to easily and preferably connect high-frequency electronic signals with the external electric circuit.

In the high-frequency electronic device of the invention, there may be a plurality of first dielectric substrates which are made into contact with the single-crystal dielectric substrate at side faces thereof so that the respective top faces are in substantially the same plane. In this case, by connecting electric circuits which are formed on the respective first dielectric substrates with the high-frequency electronic circuit formed on the single-crystal dielectric substrate, it is possible to construct an increased variety of electronic circuits and improve the high-frequency electronic device in electric characteristics. Also in this case, by combining dielectric substrates having different dielectric constants and dielectric losses, it is possible to bring changes in characteristic impedance, loss and the like in the wiring conductor layer partially, and it is possible to enhance the degree of freedom in designing a circuit. Moreover, in the case where a coaxial cable connector or a coaxial cable for connecting with an external electric circuit is connected to the second through conductor disposed on each of the plurality of first dielectric substrates, it is possible to place the coaxial cable connector or the coaxial cable at an arbitrary position.

In order to enhance the degree of freedom in placing the coaxial cable connector or the coaxial cable, the second dielectric substrate may be composed of a plurality of dielectric substrates.

Further, according to the high-frequency electronic device of the invention, the first ground conductor layer 13, 33, 53 is formed on the single-crystal dielectric substrate 11, 31, 51 to adhere thereto, so that it is possible to use as the conductive material forming it an orientation film or single-crystal film, in which case, it is possible to make the first ground conductor layer 13, 33, 53 into a low-loss one to stabilize and improve the high-frequency electronic circuit in characteristics.

Still further, according to the high-frequency electronic device of the invention, the single-crystal dielectric substrate 11, 31, 51 has a property of allowing infrared rays to pass through, whereby in the case of using a thermally-bonding-type adhesive in order to attach the single-crystal dielectric substrate 11, 31, 51 to the first and second dielectric substrates 14, 34, 54; 16, 36, 56, it is possible to utilize infrared rays to heat and adhere them with a little consumption power and in a short time period, thereby attaching them to each other. On the other hand, in the case where the single-crystal dielectric substrate 11, 31, 51 allows ultraviolet rays to pass through, it is possible to use an ultraviolet-ray-curing adhesive in order to attach the single-crystal dielectric substrate 11,31, 51 to the first and second dielectric substrates 14, 34, 54; 16, 36, 56, thereby attaching them to each other without heating the high-frequency electronic device.

In the high-frequency electronic device of the invention, X-rays, visible light rays, infrared rays or the like is used in registration of wiring for electrically connecting the respective wiring conductor layers formed on each dielectric substrate, whereby the wiring conductor layers interposed between the dielectric substrates can be registered from the outside in a simple manner.

Further, in the high-frequency electronic device of the invention, in the case where a coaxial cable connector which is electrically connected with the second through conductor 22, 42, 62 is attached to the first dielectric substrate 14, 34, 54 or the second dielectric substrate 16, 36, 56, and a screw for fixing the coaxial cable connector is used as the first through conductor 19, 39, 59 for electrically connecting the second ground conductor layer 15, 35, 55 with the third ground conductor layer 17, 37, 57*a*, 57*b*, it is required merely to provide a through hole at which the first through conductor 19, 39, 59 is placed, on the first and second dielectric substrates 14, 34, 54; 16, 36, 56, and it is not necessary to form a conductor such as a through hole conductor or a via hole, with the result that the manufacturing process can be simplified and shortened.

Still further, in the high-frequency electronic device of the invention, in the case where the first dielectric substrate 14, 34, 54 and the second dielectric substrate 16, 36, 56 are of the same crystal structure as that of the single-crystal dielectric substrate 11, 31, 51, a dielectric constant thereof becomes close to that of the single-crystal dielectric substrate 11, 31, 51 and hence designing of the wiring conductor is facilitated, as well as a coefficient of thermal expansion thereof becomes close and hence it is possible to prevent peel-off from the single-crystal dielectric substrate 11, 31, 51 due to temperature hysteresis.

Still further, in the high-frequency electronic device of the invention, by adopting a structure of interposing a thermally-bonding-type conductive material in order to electrically connect the first wiring conductor layer 12, 32, 52 with the second wiring conductor layer 20, 40, 60, it is possible to connect the wiring conductor layers with each other by heating from outside in a simple and reliable manner after attaching the dielectric substrates to each other. In this case, use of solder, solder paste, or a conductive adhesive which has a low resistance as the thermally-bonding-type conductive material makes it possible to limit heat which is generated due to the electric resistance of the thermally-bonding-type conductive material at a connecting portion of the wiring conductor layers after connection. In the case where the single-crystal dielectric substrate 11, 31, 51 allows infrared rays to pass through, heating the thermally-bonding-type conductive material by infrared rays is adopted as a method of adhering by the thermally-bonding-type conductive material, whereby it is possible to precisely control a heat amount by the amount and time period of irradiation of infrared rays, and furthermore, it is possible to heat only around the thermally-bonding-type conductive material by converged infrared rays. Therefore, it can be avoided that a wiring conductor layer and an electronic component other than a connecting portion which are not desired to be heated are heated excessively, and hence it is possible to prevent the high-frequency electronic circuit from being degraded in electric characteristics due to heat.

In the case of thus heating by infrared rays, by using a gold thin film as the thermally-bonding-type conductive material and laminating the gold thin film also on a wiring conductor which comes into contact with the thermally-bonding-type conductive material, it is possible to prevent the connecting portion from being oxidized due to heating.

In the high-frequency electronic device of the invention, in the case where part or all of the first wiring conductor layer 12, 32, 52 formed on the single-crystal dielectric substrate 11, 31, 51 is formed of a superconductor thin film, the first wiring conductor layer 12, 32, 52 formed on the single-crystal dielectric substrate 11, 31, 51 and the high-frequency electronic circuit constituted thereby can be made into low-loss ones.

Further, in the case where the first to third ground conductor layers 13, 33, 53; 15, 35, 55; 17, 37, 57*a*, 57*b* which are ground planes placed on and under the first wiring conductor layer 12, 32, 52 formed on the single-crystal dielectric substrate 11, 31, 51 by using a superconductor thin film, are formed by using a superconductor thin film, it is possible to make the ground planes into considerably low-loss ones.

Furthermore, in the case where the first ground conductor layer 13, 33, 53 is formed by using a superconductor thin film which is adhered to the single-crystal dielectric substrate 11, 31, 51, this first ground conductor layer 13, 33, 53 can be formed of an orientation film or single-crystal film, and it is possible to make the first ground conductor 13, 33, 53 into an extremely low-loss one.

In the high-frequency electronic device of the second aspect of the invention it is preferable that the impedance transformer is of a quarter-wavelength-type or taper-type.

According to the invention, the impedance transformer can be constituted by a distributed constant circuit which is used for high-frequency circuits and by a thin-film circuit.

In the high-frequency electronic device of the first aspect of the invention it is preferable that the single-crystal dielectric substrate 11, 31, 51 and the first and/or second dielectric substrates 14, 34, 54; 16, 36, 56 are different in dielectric constant.

According to the invention, it is possible to respectively change the characteristic impedance of the first and/or second wiring conductor layers 12, 32, 52; 20, 40, 60 without changing the design for the line widths of the wiring conductor layers, and to make the wiring conductor layers into low-loss ones by increasing the line widths without changing the characteristic impedance, and hence it is possible to enhance the degree of freedom for designing a high-frequency electronic circuit which is constituted by the first wiring conductor layer 12, 32, 52, or by the first wiring conductor layer 12, 32, 52 and the second wiring conductor layer 20, 40, 60.

In the high-frequency electronic device of the first aspect of the invention it is preferable that a wiring conductor layer for constituting a high-frequency electronic circuit is formed on a bottom face of the second dielectric substrate 16, 36, 56 to adhere thereto.

According to the invention, by electrically connecting this wiring conductor layer with the first and/or second wiring conductor layers 12, 32, 52; 20, 40, 60, a more complicated high-frequency electronic circuit can be constituted, and accordingly the high-frequency electronic device can be improved in electric characteristics.

In the high-frequency electronic device of the first aspect of the invention it is preferable that the first dielectric substrate 14, 34, 54 and/or second dielectric substrate 16, 36, 56 is composed of a plurality of dielectric substrates.

According to the invention, it is possible to constitute a variety of electronic circuits and improve the high-frequency electronic device in electric characteristics. By combining dielectric substrates having different dielectric constants and dielectric losses, it is possible to bring changes in characteristic impedance, loss and the like in the wiring conductor layer partially, and it is possible to enhance the degree of freedom in designing a circuit. A coaxial cable and connector used for connecting with an external circuit can be placed at an arbitrary position.

In the high-frequency electronic device of the first aspect of the invention it is preferable that at least one of the first ground conductor layer 13, 33, 53, the second ground conductor layer 15, 35, 55, the third ground conductor layer 17, 37, 57*a*, 57*b*, the first wiring conductor layer 12, 32, 52, and the second wiring conductor layer 20, 40, 60 is formed of an orientation film, single-crystal film, or superconducting thin film.

According to the invention, as mentioned later in connection with FIGS. 1A, 1B, 2A–2D, 3A–3E and 4A–4G, it is possible to make the conductor layers into low-loss ones to stabilize and improve the high-frequency electronic circuit in characteristics. As a result, heat generated from a high-frequency electronic circuit can be efficiently suppressed.

In the high-frequency electronic device of the first aspect of the invention it is preferable that the first wiring conductor layer 12, 32, 52 and the second wiring conductor layer 20, 40, 60 are electrically connected with each other by a thermally-bonding-type conductive material.

According to the invention, as mentioned later in connection with FIGS. 1A, 1B, 2A–2D, 3A–3E and 4A–4G, it is possible to connect the wiring conductor layers with each other by heat coming from the outside in a simple and reliable manner after attaching the dielectric substrates to each other.

In the high-frequency electronic device of the first aspect of the invention it is preferable that the first dielectric substrate 14, 34, 54 and the second dielectric substrate 16, 36, 56 are of the same crystal structure. More specifically, the dielectric substrates are composed of a poly-crystal or single-crystal dielectric having the same molecular formula as the single-crystal dielectric substrate 11, 31, 51.

According to the invention, as mentioned later in connection with FIGS. 1A, 1B, 2A–2D, 3A–3E and 4A–4G, the first and second dielectric substrates 14, 34, 54; 16, 36, 56 have close dielectric constants to that of the single-crystal dielectric substrate 11, 31, 51, thereby facilitating design of the wiring conductor layer. Also they have close coefficients of heat expansion to that of the single-crystal dielectric substrate 11, 31, 51, thereby enabling to avoid peel-off from the single-crystal dielectric substrate due to temperature hysteresis. The difference in dielectric constant is reduced, and hence it is facilitated to control matching in impedance at a connecting electrode portion of the wiring conductor layers on a plurality of dielectric substrates having different dielectric constants. The coefficients of heat expansion of the respective dielectric substrates also become close, and hence it is possible to prevent peel-off at an attachment joint portion of the dielectric substrates due to variation in temperature.

In the high-frequency electronic device of the first aspect of the invention it is preferable that a coaxial cable connector 23, 43, 63 is electrically connected with the second through conductor 22, 42, 62, and a conductive fixing member 26, 46, 66 of the coaxial cable connector is used as the first through conductor 19, 39, 59.

According to the invention, as mentioned later in connection with FIGS. 1A, 1B, 2A–2D, 3A–3E and 4A–4G, while the coaxial cable connector 23, 43, 63 is placed at an arbitrary position on the top face of the first dielectric substrate 14, 34, 54 or the second dielectric substrate 16, 36, 56, it is possible to connect a ground conductor 24, 44, 64 of the coaxial cable connector 23, 43, 63 with the second ground conductor layer 15, 35, 55 or the third ground conductor layer 17, 31, 57*a*, 57*b* in a simple and low-loss manner, and it is possible to transmit/receive high-frequency electric signals to/from an external electric circuit in a simple and preferable manner. It is required merely to form a through hole at which the first through conductor 19, 39, 59 is placed, on the first and second dielectric substrates 14, 34, 54; 16, 36, 56, and it is no more necessary to form a conductor such as a through hole conductor and a via conductor inside thereof, with the result that a manufacturing process can be simplified and shortened.

Now referring to the drawings, preferred embodiments of the invention are described below.

Figure 1B:
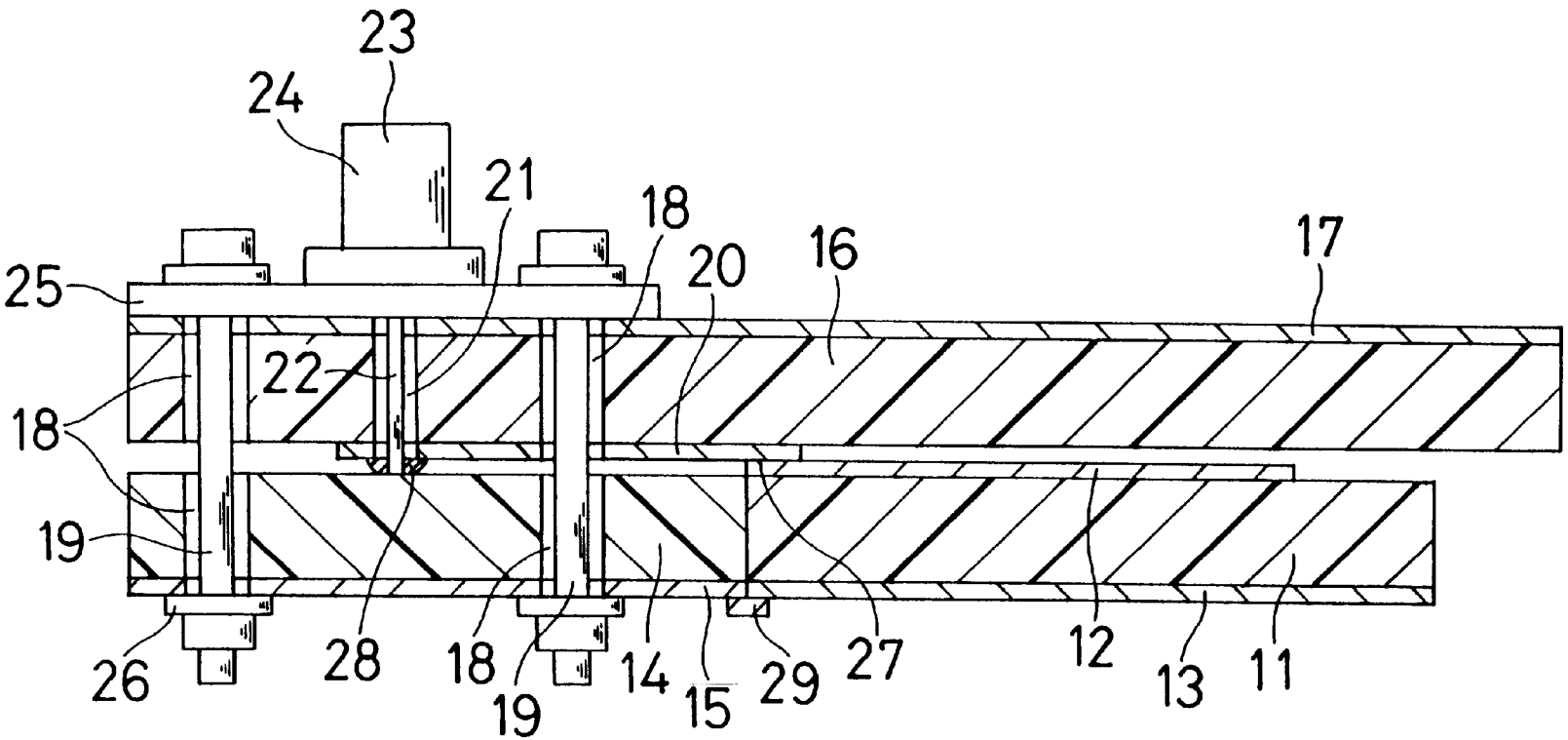
FIG. 1B is a sectional view thereof.

FIG. 1A is a perspective view showing an embodiment of a high-frequency electronic device of the invention, and FIG. 1B is a sectional view thereof.

In FIG. 1A and 1B, reference numeral 11 denotes a single-crystal dielectric substrate which is one of dielectric substrates constituting the high-frequency electronic device, reference numeral 12 a first wiring conductor layer which is formed on the top face of the single-crystal dielectric substrate 11 to form a high-frequency electronic circuit, reference numeral 13 a first ground conductor layer which is a ground plane formed on almost the entire face of the bottom face of the single-crystal dielectric substrate 11, reference numeral 14 a first dielectric substrate whose side face is made into contact with the side face of the single-crystal dielectric substrate 11 so that the top faces thereof mutually form substantially the same plane, reference numeral 15 a second ground conductor layer which is formed on almost the entire face of the bottom face of the first dielectric substrate 14, reference numeral 16 a second dielectric substrate attached to the top faces of the single-crystal dielectric substrate 11 and the first dielectric substrate 14 via an electrical insulator so as to cover the top face of the single-crystal dielectric substrate 11, and reference numeral 17 a third ground conductor layer which is formed on almost the entire face of the top face of the second dielectric substrate 16.

A first through conductor 19 passes through the first dielectric substrate 14 and the second dielectric substrate 16 to electrically connect the second ground conductor layer 15 with the third ground conductor layer 17. In this embodiment, a screw for fixing a coaxial cable connector 23 which is inserted into a through hole 18 disposed to the first dielectric substrate 14 and the second dielectric substrate 16 is used as the first through conductor 19.

A second wiring conductor layer 20 is formed on the bottom face of the second dielectric substrate 16 and electrically connected with the first wiring conductor layer 12 via a connecting electrode portion 27. As shown in FIG. 1B, the connecting electrode portion 27 connects to the second wiring conductor layer and overlaps a part of the first wiring conductor 12. As a result, a part of the bottom face of the second dielectric substrate is spaced a distance from the first wiring conductor 12. A second through conductor 22 is utilized as the second through conductor 22, by inserting a conductor line which is connected with the central conductor of the coaxial cable connector 23 into a through hole 21 which is disposed to the second dielectric substrate 16. One end thereof is electrically connected with the second wiring conductor layer 20 at a connecting electrode portion 28 which is disposed to the second wiring conductor layer 20, and the other end thereof is electrically connected with the central conductor of the coaxial cable connector 23 attached to the top face of the second dielectric substrate 16. A coaxial cable which comes from an external electric circuit is connected with the coaxial cable connector 23, whereby the first wiring conductor layer 12 is electrically connected with the external electric circuit, and high-frequency electric signals are exchanged between the external electric circuit and the high-frequency electronic device.

In this embodiment, the coaxial cable connector 23 is attached to the top face of the second dielectric substrate 16, and an outside conductor 24 of this coaxial cable connector 23 is electrically connected with the third ground conductor 17 formed on the second dielectric substrate 16 via a connector-fixing component 25 which is made of metal. Moreover, the second ground conductor layer 15 formed on the bottom face of the first dielectric substrate 14 and the fixing screw serving as the first through conductor 19 are electrically connected with each other via a connector-fixing component 26 which is made of metal, whereby the second ground conductor layer 15 and the third ground conductor layer 17 are electrically connected with each other via the first through conductor 19.

It is needless to say that as the first through conductor 19 and the second through conductor 22, a through hole conductor, a via conductor or the like which is formed so as to pass through the first dielectric substrate 14 and the second dielectric substrate 16 may be used.

Further, the first ground conductor layer 13 formed on the single-crystal dielectric substrate 11, as well as the second ground conductor layer 14 and the third ground conductor layer 15 are formed of a conductive material such as Pt, Au, Ag, Cu, Ni, Cr, Mo, Mn, Ti, W, Nb, NbN, $YBa_2Cu_3,O_x$, $Bi_2Sr_2Ca_2Cu_3O_y$ and $Tl_2Ba_2Ca_2Cu_3O_z$. The first ground conductor layer 13 is electrically connected with the second ground conductor layer 15 formed on the first dielectric substrate 14 via a conductive member 29, with the result that the first ground conductor layer 13, the second ground conductor layer 15, and the third ground conductor layer 17 are electrically connected with each other.

In particular, in the case where a superconductor is used as the conductive member 29 and used at a critical temperature thereof or below, a circuit can be made to be a considerably low-loss one. Moreover, in the case where a member which is resistant to oxidization, for example, Au, Ag, or Pt is laminated on the conductive member 29, it is possible to prevent the conductive material 29 from being oxidized.

Figure 2A:
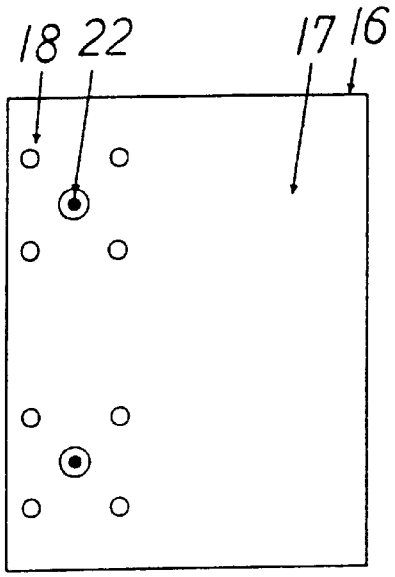
FIG. 2A is a top view of a second dielectric substrate which is used in the high-frequency electronic device shown in FIGS. 1A and 1B.
Figure 2C:
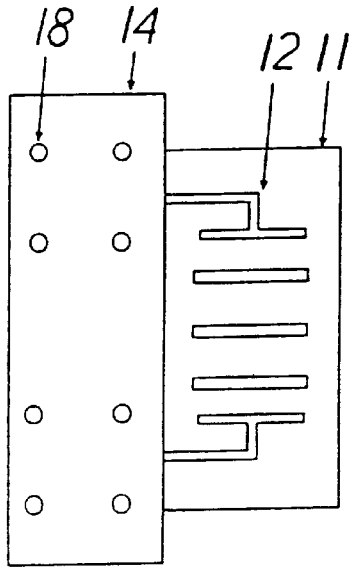
FIG. 2C is a top view of a single-crystal dielectric substrate and a first dielectric substrate.
Figure 2B:
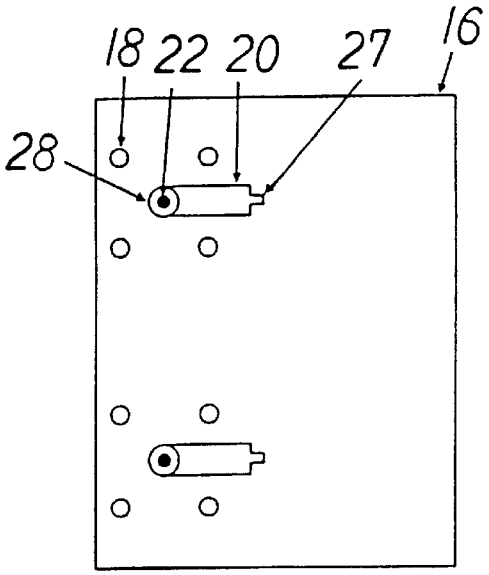
FIG. 2B is a bottom view of the second dielectric substrate.
Figure 2D:
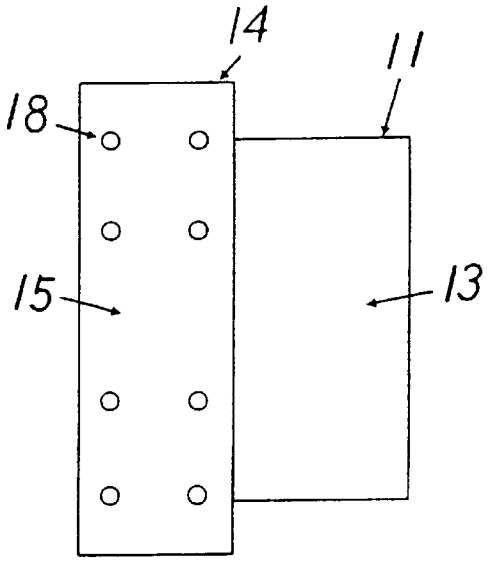
FIG. 2D is a bottom view of the single-crystal dielectric substrate and the first dielectric substrate.

FIGS. 2A to 2D are plane views showing the top faces and bottom faces of the respective dielectric substrates of the high-frequency electronic device as shown in FIGS. 1A and 1B. FIG. 2A is a top view of the second dielectric substrate 16, FIG. 2B is a bottom view of the second dielectric substrate 16, FIG. 2C is a top view of the single-crystal dielectric substrate 11 and the first dielectric substrate 14, and FIG. 2D is a bottom view of the single-crystal dielectric substrate I1 and the first dielectric substrate 14, wherein the same reference numerals are given to such portions that are identical to those of FIGS. 1A and 1B.

Figure 3A:
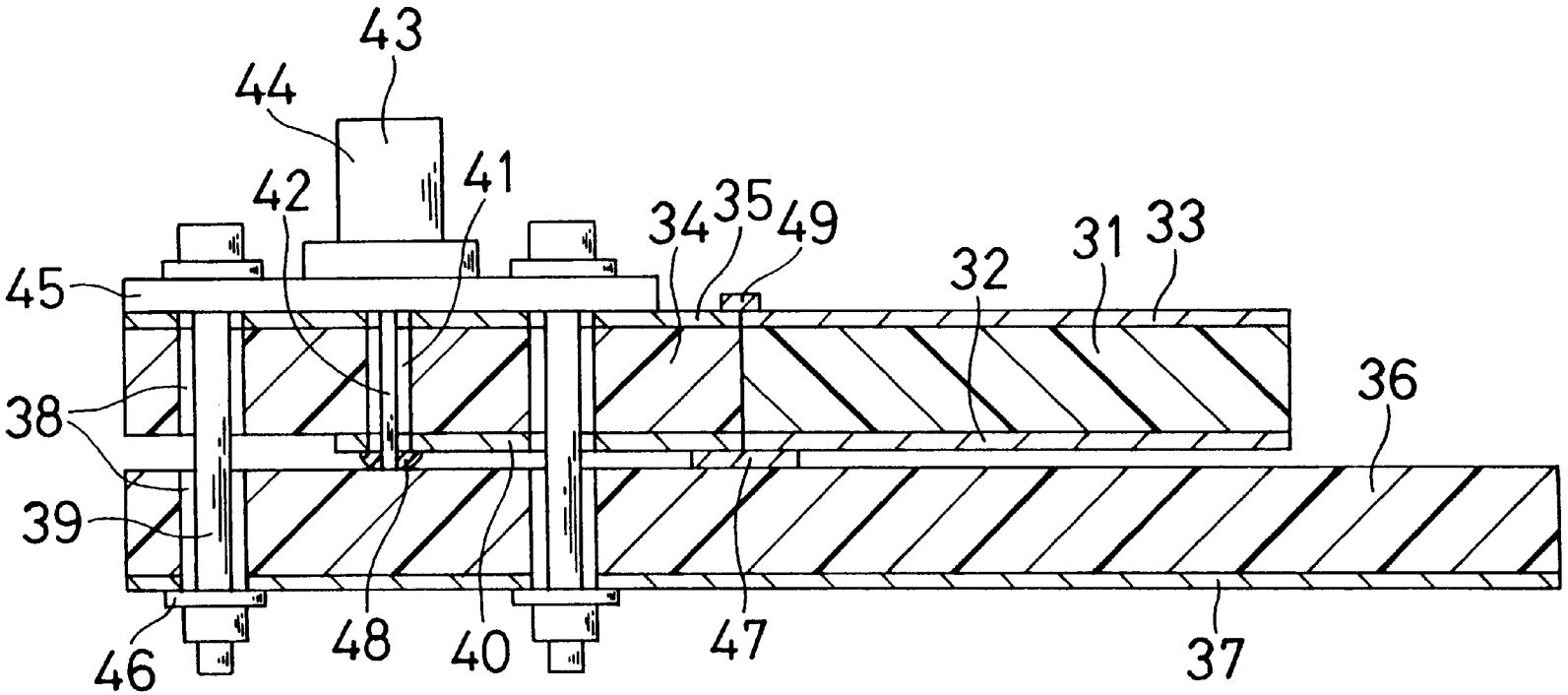
FIG. 3A is a sectional view showing another embodiment of the high-frequency electronic device of the invention.
Figure 3B:
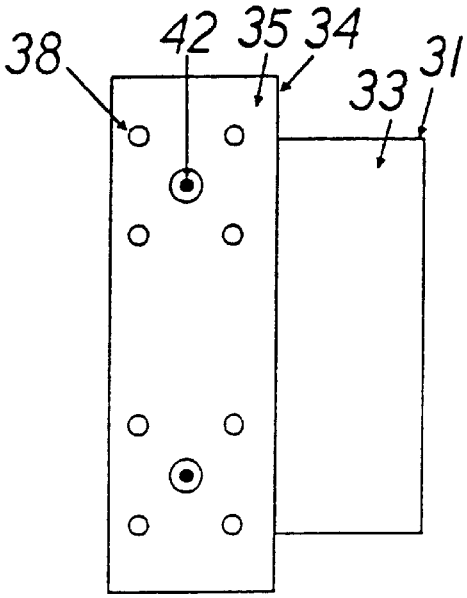
FIG. 3B is a top view of a single-crystal dielectric substrate and a first dielectric substrate.
Figure 3D:
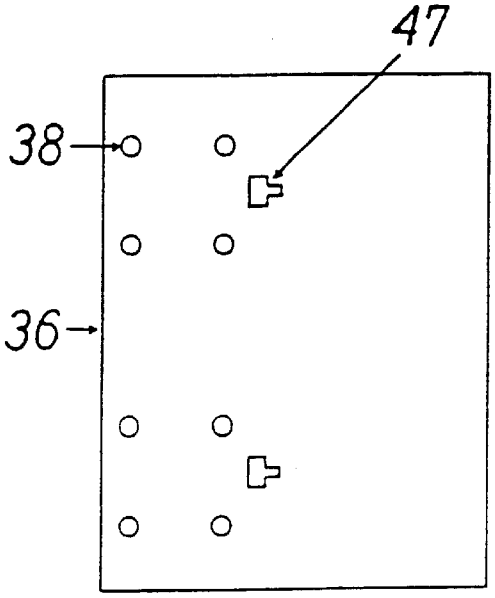
FIG. 3D is atop view of a second dielectric substrate.
Figure 3C:
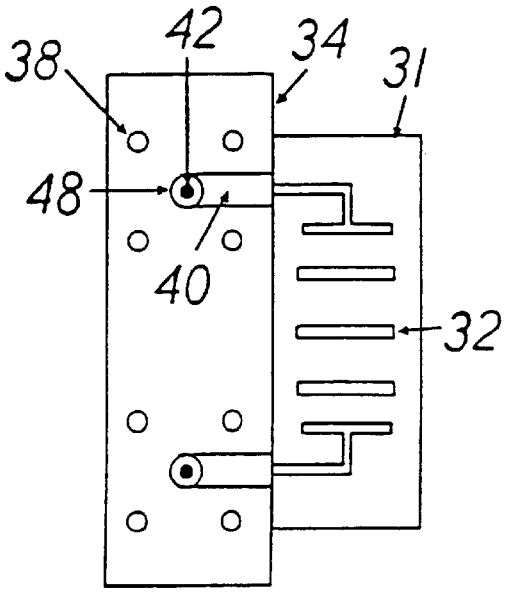
FIG. 3C is a bottom view of the single-crystal dielectric substrate and the first dielectric substrate.
Figure 3E:
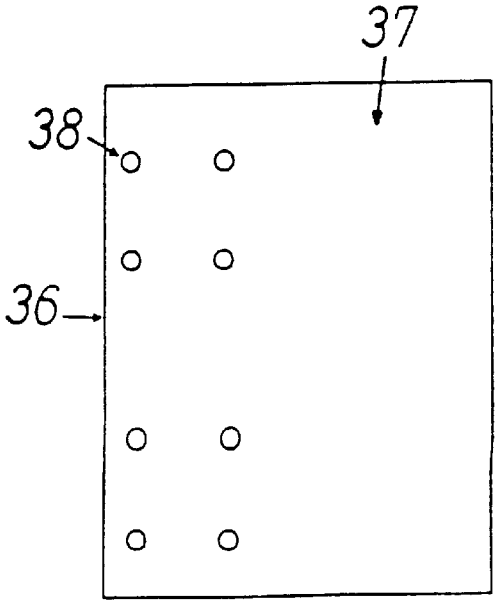
FIG. 3E is a bottom view of the second dielectric substrate.

Next, FIGS. 3A to 3E show another embodiment of the high-frequency electronic device of the invention. FIG. 3A is a sectional view which is identical to FIG. 1B, wherein the positional relation between the single-crystal dielectric substrate 31 and the first dielectric substrate 34, and the second dielectric substrate 36 is shown so as to be opposite to that of FIG. 1B. Further, FIG. 3B is a top view of the single-crystal dielectric substrate and the first dielectric substrate of the high-frequency electronic device as shown in FIG. 3A, FIG. 3C is a bottom view of the single-crystal dielectric substrate and the first dielectric substrate, FIG. 3D is a top view of the second dielectric substrate, and FIG. 3E is a bottom view of the second dielectric substrate.

In these drawings, reference numeral 31 denotes a single-crystal dielectric substrate, reference numeral 32 denotes a first wiring conductor layer which is formed on the bottom face of the single-crystal dielectric substrate 31 to constitute the high-frequency electronic circuit, reference numeral 33 denotes a first ground conductor layer which is a ground plane formed on almost the entire face of the top face of the single-crystal dielectric substrate 31, reference numeral 34 denotes a first dielectric substrate whose side face is made into contact with the side face of the single-crystal dielectric substrate 31 so that the bottom faces thereof mutually form substantially the same plane, reference numeral 35 denotes a second ground conductor layer which is adhered and formed on almost the entire face of the top face of the first dielectric substrate 34, reference numeral 36 denotes a second dielectric substrate which covers the bottom face of the single-crystal dielectric substrate 31 to be attached to the bottom faces of the single-crystal dielectric substrate 31 and the first dielectric substrate 34, and reference numeral 37 denotes a third ground conductor layer which is formed on almost the entire face of the bottom face of the second dielectric substrate 36.

Reference numeral 39 denotes a first through conductor which passes through the first dielectric substrate 34 and the second dielectric substrate 36 to electrically connect the second ground conductor layer 35 with the third ground conductor 37. Also in this embodiment, a screw for fixing a coaxial cable connector 43 which is inserted into a through hole 38 disposed to the first dielectric substrate 34 and the second dielectric substrate 36, which is utilized as the first through conductor 39.

A second wiring conductor layer 40 is formed on the bottom face of the first dielectric substrate 34 and electrically connected with the first wiring conductor layer 32 via a connecting electrode portion 47 which is formed on the top face of the second dielectric substrate 36. A second through conductor 42 is utilized as the second through conductor 42 by inserting a conductor line which is connected with the central conductor of the coaxial cable connector 43 into a through hole 41 which is disposed to the first dielectric substrate 34. One end thereof is electrically connected with the second wiring conductor layer 40 at a connecting electrode portion 48 which is disposed to the second wiring conductor layer 40, and the other end thereof is electrically connected with the central conductor of the coaxial cable connector 43 attached to the top face of the first dielectric substrate 34. A coaxial cable which comes from an external electric circuit is connected with the coaxial cable connector 43, whereby the first wiring conductor layer 32 is electrically connected with the external electric circuit, and high-frequency electric signals are exchanged between the external electric circuit and the high-frequency electronic device.

In this embodiment, the coaxial cable connector 43 is attached to the top face of the first dielectric substrate 34, and an outside conductor 44 of this coaxial cable connector 43 is electrically connected with the second ground conductor 35 formed on the first dielectric substrate 34 via a connector-fixing component 45 which is made of metal. Further, the third ground conductor layer 37 formed on the bottom face of the second dielectric substrate 36 and the fixing screw serving as the first through conductor 39 are electrically connected with each other via a connector-fixing component 46 which is made of metal, whereby the second ground conductor layer 35 and the third ground conductor layer 37 are electrically connected with each other via the first through conductor 39.

It is also needless to say that as the first through conductor 39 and the second through conductor 42, a through hole conductor, a via conductor or the like which is formed so as to pass through the first dielectric substrate 34 and the second dielectric substrate 36 may be used.

Further, the first ground conductor layer 33 formed on the single-crystal dielectric substrate 31 is electrically connected with the second ground conductor layer 35 formed on the first dielectric substrate 34 via a conductive member 49, with the result that the first ground conductor layer 33, the second ground conductor layer 35, and the third ground conductor layer 37 are electrically connected with each other.

Next, still another embodiment of the high-frequency electronic device of the invention will be shown in FIGS. 4A to 4G.

Figure 4A:
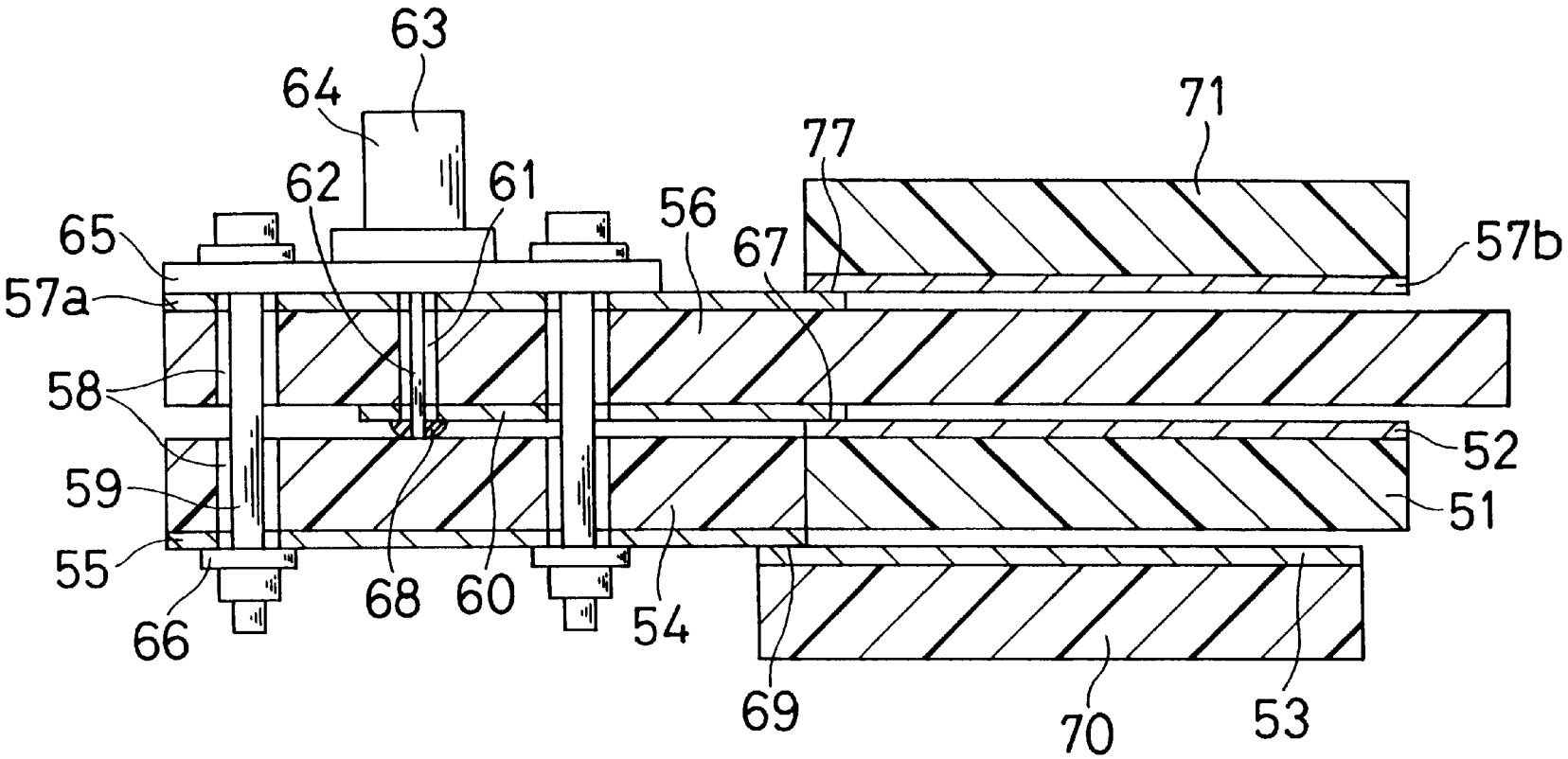
FIG. 4A is a sectional view showing still another embodiment of the high-frequency electronic device of the invention.
Figure 4F:
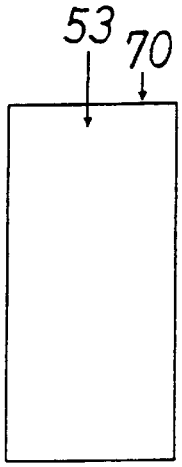
FIG. 4F is a top view of a ground plane single-crystal dielectric substrate which is attached to the bottom face of the single-crystal dielectric substrate.
Figure 4B:
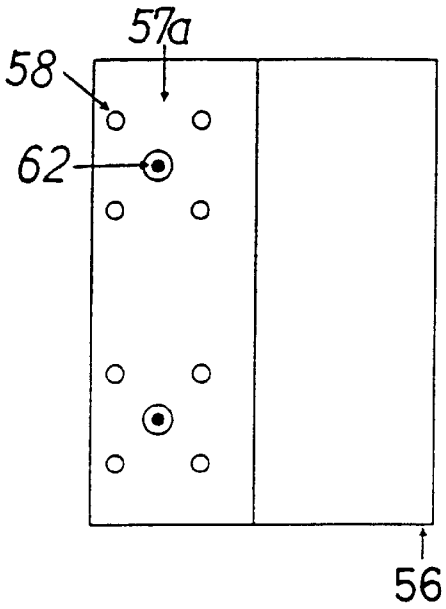
FIG. 4B is a top view of a second dielectric substrate.
Figure 4D:
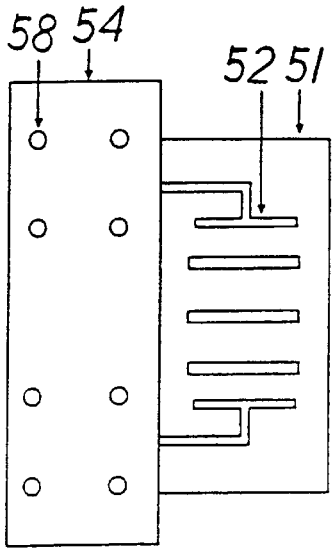
FIG. 4D is a top view of a single-crystal dielectric substrate and a first dielectric substrate.
Figure 4G:
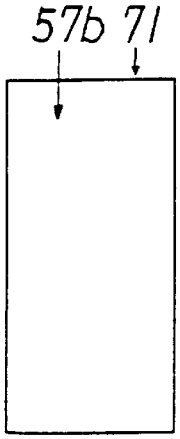
FIG. 4G is a bottom view of a ground place single-crystal dielectric substrate which is attached to the top face of the second dielectric substrate.
Figure 4C:
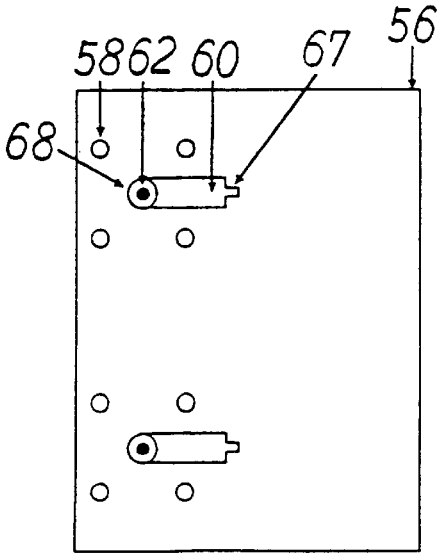
FIG. 4C is a bottom view of the second dielectric substrate.
Figure 4E:
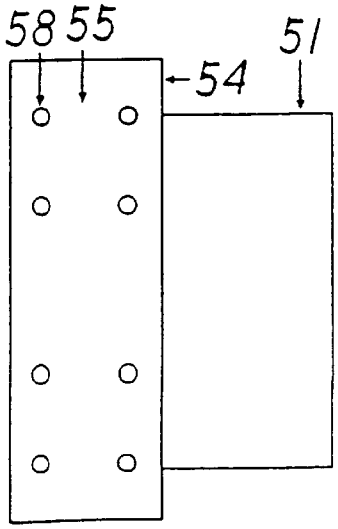
FIG. 4E is a bottom view of the single-crystal dielectric substrate and the first dielectric substrate.

FIG. 4A is a sectional view which is identical to FIG. 3A, wherein the positional relation of the single-crystal dielectric substrate and the first dielectric substrate with respect to the second dielectric substrate is shown so as to be the same as FIG. 1B (inverse to FIG. 3A) . Further, FIG. 4B is a top view of the second dielectric substrate of the high-frequency electronic device as shown in FIG. 4A, FIG. 4C is a bottom view of the second dielectric substrate, FIG. 4D is a top view of the single-crystal dielectric substrate and the first dielectric substrate, FIG. 4E is a bottom view of the single-crystal dielectric substrate and the first dielectric substrate, FIG. 4F is a top view of a ground plane single-crystal dielectric substrate which is attached to the bottom face of the single-crystal dielectric substrate, and FIG. 4G is a bottom view of a ground plane single-crystal dielectric substrate which is attached to the top face of the second dielectric substrate.

In these drawings, reference numeral 51 denotes a single-crystal dielectric substrate, reference numeral 52 denotes a first wiring conductor layer which is formed on the top face of the single-crystal dielectric substrate 51 to constitute the high-frequency electronic circuit, and reference numeral 53 denotes a first ground conductor layer which is a ground plane formed on almost the entire face of the bottom face of the single-crystal dielectric substrate 51. In this embodiment, the first ground conductor layer 53 is formed on the top face of a ground plane single-crystal substrate 70 as a superconducting single-crystal conductor layer, attached to the bottom face of the single-crystal dielectric substrate 51 and electrically connected with a second ground conductor layer via a connecting electrode portion 69, thereby formed on almost the entire face of the bottom face of the single-crystal dielectric substrate 51.

Further, in this embodiment, a superconducting single-crystal conductor layer is used as the first wiring conductor layer 52 constituting the high-frequency electronic circuit, whereby a low-loss high-frequency electronic circuit can be constituted. The reason is that the surface resistance of a superconductor at a high-frequency is considerably small.

At 1–10 GHz, which is the frequency of a microwave used in general, a superconductor ($YBa_2Cu_3O_x$ or the like) has a considerably small surface resistance, which is one thousandth to one hundredth of that of Cu having a small surface resistance.

Reference numeral 54 denotes a first dielectric substrate whose side face is made into contact with the side face of the single-crystal dielectric substrate 51 so that the top faces thereof mutually form substantially the same plane, reference numeral 55 denotes the second ground conductor layer which is formed on almost the entire face of the bottom face of the first dielectric substrate 54, reference numeral 56 denotes a second dielectric substrate which covers the top face of the single-crystal dielectric substrate 51 to be attached to the top faces of the single-crystal dielectric substrate 51 and the first dielectric substrate 54, reference numeral 57*a* denotes a third ground conductor layer which is formed on almost the entire face in a region corresponding to the first dielectric substrate 54 of the top face of the second dielectric substrate 56, and reference numeral 57*b* denotes another third ground conductor layer which is formed and attached to the bottom face of a ground plane single-crystal substrate 71 as a superconducting single-crystal conductor layer, thereby formed on almost the entire face in a region corresponding to the single-crystal dielectric substrate 51 of the top face of the second dielectric substrate 56. These two third ground conductor layers 57*a* and 57*b* are electrically connected with each other via a connecting electrode portion 77.

Reference numeral 59 denotes a first through conductor which passes through the first dielectric substrate 54 and the second dielectric substrate 56 to electrically connect the second ground conductor layer 55 with the third ground conductor 57*a*. Also in this embodiment, a screw for fixing a coaxial cable connector 63 which is inserted into a through hole 58 disposed to the first dielectric substrate 54 and the second dielectric substrate 56 is used as the first through conductor 59.

A second wiring conductor layer 60 is formed on the bottom face of the second dielectric substrate 56 and electrically connected with the first wiring conductor layer 52 via a connecting electrode portion 67 which is formed on the bottom face of the second dielectric substrate 56. A second through conductor 62 is utilized as the second through conductor 62 by inserting a conductor line which is connected with the central conductor of the coaxial cable connector 63 is inserted into a through hole 61 which is disposed to the second dielectric substrate 56. One end thereof is electrically connected with the second wiring conductor layer 60 at a connecting electrode portion 68 which is disposed to the second wiring conductor layer 60, and the other end thereof is electrically connected with the central conductor of the coaxial cable connector 63 attached to the top face of the second dielectric substrate 56. A coaxial cable which comes from an external electric circuit is connected with the coaxial cable connector 63, whereby the first wiring conductor layer 52 is electrically connected with the external electric circuit, and high-frequency electric signals are exchanged between the external electric circuit and the high-frequency electronic device.

In this embodiment, the coaxial cable connector 63 is attached to the top face of the second dielectric substrate 56, and an outside conductor 64 of this coaxial cable connector 63 is electrically connected with the third ground conductor layer 57*a* formed on the top face of the second dielectric substrate 56 via a connector-fixing component 65 which is made of metal. Further, the second ground conductor layer 55 formed on the bottom face of the first dielectric substrate 54 and the fixing screw serving as the first through conductor 59 are electrically connected with each other via a connector-fixing component 66 which is made of metal, whereby the second ground conductor layer 55 and the third ground conductor layers 57*a*, 57*b* are electrically connected with each other via the first through conductor 59.

It is also needless to say that as the first through conductor 59 and the second through conductor 62, a through hole conductor, a via conductor or the like which is formed so as to pass through the first dielectric substrate 54 and the second dielectric substrate 56 may be used.

Further, the first ground conductor layer 53 which is formed on the single-crystal dielectric substrate 51 by the ground plane single-crystal dielectric substrate 70 is electrically connected with the second ground conductor layer 55 formed on the first dielectric substrate 54 via the conductive member serving as the conductive member 69, with the result that the first ground conductor layer 53, the second ground conductor layer 55, and the third ground conductor layers 57*a*, 57*b* are electrically connected with each other.

According to this embodiment, it is possible to produce all of the first wiring conductor layer 52, the third ground conductor layer 57*b*, and the first ground conductor layer 53 by using a superconducting single-crystal conductor layer, so that it is possible to complete an extremely low-loss high-frequency electronic circuit.

With reference to the high-frequency electronic devices of the invention as shown in FIGS. 1A to 4G, the connecting electrode portion 27, 28, 47, 48, 67, 68 can also flow a high-frequency current to electrically connect by electromagnetic coupling.

Further, by changing the line width of electric wiring at the connecting electrode portion 27, 47, 67 at the boundary of the dielectric substrates so that matching in impedance becomes optimal, it is possible to limit the reflection intensity of electric signals at a connecting portion of the wiring conductor layers formed on a plurality of dielectric substrates having different electric constants.

Still further, although a screw for fixing a coaxial cable connector is used for electrical connection of the second ground conductor layer and the third ground conductor layer in the high-frequency electronic devices of the invention as shown in FIGS. 1A to 4G, in the case of such a high-frequency electronic device that handles a high-frequency current whose wavelength corresponds to a length of about 1 cm, which is a general size of the central conductor of a coaxial cable connector and the fixing screw, it is desirable to produce a through conductor specifically for a ground plane so that a distance thereof from the central conductor becomes equal to or less than the wavelength of the high-frequency current. The reason is that in the case where the distance of the through conductor for the ground plane is longer than the wavelength of a high-frequency current, a high-frequency current is difficult to flow.

With reference to the high-frequency electronic device of the invention, although the respective dielectric substrates are not restricted in crystal structure and composition in particular, in the case where the dielectric substrates except the single-crystal dielectric substrate is made to be of the same crystal structure as the single-crystal dielectric substrate and a poly-crystal structure, the difference in dielectric constant is decreased between the single-crystal dielectric substrate and the poly-crystal substrates, and it is facilitated to control matching in impedance at the connecting portion of the wiring conductor layers formed on the plurality of dielectric substrates having different dielectric constants. Moreover, the thermal expansion coefficients of the respective dielectric substrates becomes close to each other, and hence it is possible to prevent attachment joint portions of the dielectric substrates from peeling off due to a variation in temperature. As a material for such substrates, any dielectric substrate material may be used as long as a single-crystal dielectric substrate can be produced thereby, for example, $Al_2O_3$, $SiO_2$, MgO, $LaAlO_3$.

Further, as the first dielectric substrate and the second dielectric substrate, a single-crystal dielectric substrate may be used, although it is difficult to produce a through conductor thereon.

With reference to the high-frequency electronic device of the invention, by making the respective electrode portions have a structure of adhering by use of a thermally-bonding-type conductive material, it is possible to decrease loss at the connecting electrode portions. This thermally-bonding-type conductive material may be any conductive material that adheres at a temperature lower than the melting point of a dielectric substrate material. However, in the case of specifically using -solder, solder paste, or a conductive adhesive, it is possible to connect at a low temperature of 400° C. or less and protect an electronic circuit formed on a single-crystal dielectric substrate made of a metal, oxide, nitride, carbide, organic or the like in general from being degraded in electric characteristics due to a high temperature, which is desirable. That is to say, it is possible to avoid oxidization due to a high temperature in the case where a wiring conductor layer constituting a high-frequency electronic circuit is made of a metal, it is possible to prevent a partial release of oxygen due to a high temperature in the case where the wiring conductor layer is made of oxide, and it is possible to prevent a reaction with oxygen due to a high temperature in the case where the wiring conductor layer is made of nitride, carbide, or organic. Although any solder, solder paste, or conductive adhesive that adheres at a temperature of 400° C. or less, at which temperature oxygen actively reacts, may be used, it is more preferable as the thermal expansion coefficient thereof is closer to that of the wiring conductor layer. As a heat-adhesion method of the thermally-bonding-type conductive material, any method may be adopted as long as the thermally-bonding-type conductive material is heated up to an adhesion temperature, and a simple method is to merely heat the whole high-frequency electronic device by hot plate, oven or the like. However, in this method, the high-frequency electronic circuit formed on the single-crystal dielectric substrate is degraded in electric characteristics to not small extent because of elevation in temperature. Therefore, the optimal heating method of the thermally-bonding-type conductive material is to directly heat the thermally-bonding-type conductive material through the single-crystal dielectric substrate by use of a laser beam or infrared rays, thereby heating only the vicinity of the connecting electrode portion of the wiring conductor layers without heating the high-frequency electronic device. According to this method, it is possible to efficiently protect the high-frequency electronic circuit formed on the single-crystal dielectric substrate from being degraded in electric characteristics due to elevation in temperature.

Further, with regard to these methods of heating by a laser beam and infrared rays, in the case of using a gold thin film instead of the thermally-bonding-type conductive material, it is possible to complete clean wiring connection free from contamination by flux included in solder and solder paste, an organic solvent included in a conductive adhesive, and the like, and it is possible to reduce loss at the connecting electrode portion. In this case, when a material whose melting point becomes lower than that of gold as a result of becoming an alloy with gold, is used as the material of a wiring conductor layer, it is possible to eliminate almost all of the loss at a connecting electrode portion.

Still further, in the high-frequency electronic device of the invention, as the material of the wiring conductor layer constituting the high-frequency electronic circuit on the single-crystal dielectric substrate, any kind of conductive material, metal, oxide, nitride, carbide, organic or the like that can be used as the wiring conductor layer, may be used. In particular, by forming part or all of the wiring conductor layer with a superconductor thin film, it is possible to make the high-frequency electronic circuit into a low-loss one and suppress heat generation in the most efficient manner.

Furthermore, in the case where the first ground conductor layer and the third ground conductor layer which constitute ground planes on and under the wiring conductor layer on the single-crystal dielectric substrate are also formed with a superconductor thin film in this case, it is possible to further make the high-frequency electronic circuit into a low-loss one.

In the high-frequency electronic device of the invention, it is no problem that the ground plane exists together with the high-frequency electronic circuit on the same plane, and an arbitrary number of wiring conductor layers constituting the high-frequency electronic circuit may be exist between the ground planes formed thereon and thereunder.

Further, it is preferable that the single-crystal dielectric substrate and the first dielectric substrate which are made into contact with each other so that the respective top faces mutually form substantially the same plane, are attached to each other at the side faces thereof, because a high-frequency characteristic gets better.

As an attachment method of the respective dielectric substrates, it is desirable, for example, to forcefully connect by an adhesive such as acrylic adhesive, urethane adhesive, epoxy adhesive, silicone adhesive and polyimide adhesive.

Further, in the high-frequency electronic device of the invention, at the time of connection with an external electric circuit, it is no problem to directly connect the central conductor of a coaxial cable with the second through conductor without using a coaxial cable connector. Otherwise, another means for electric connection such as a waveguide and a feeder line may be connected with an exposed end of the second through conductor.

Still further, any conductive material may be used as the conductors of the first and second through conductors, for example, a screw, pin and cable of metal, solder paste, and a conductive resin.

In the following, a concrete example of the high-frequency electronic device of the invention will be shown.

The high-frequency electronic devices of the invention were produced so as to have such structures as shown in FIGS. 1A, 1B and FIGS. 2A to 2D. In these cases, a sapphire (single crystal $Al_2O_3$) substrate whose length, width and thickness were 20 mm×20 mm×1 mm was used for the single-crystal dielectric substrate, a poly-crystal $Al_2O_3$ substrate whose length, width and thickness were 20 mm×40 mm×1 mm was used for the first dielectric substrate, and a poly-crystal $Al_2O_3$ substrate whose length, width and thickness were 40 mm×40 mm×1 mm was used for the second dielectric substrate. Gold and Cu/W were used for the first and second wiring conductor layers and the first to third ground conductor layers, a three-stage band pass filter which has a characteristic impedance of 50 Ω was constructed as a high-frequency electronic circuit, the characteristic impedance of the second wiring conductor layer was set to be 50 Ω, and an SMA coaxial connector which has a characteristic impedance of 50 Ω was used for a coaxial cable connector.

Further, as a material of an electrode for mutual wiring connection of the wiring conductor layers, such a material was used that was selected as necessary from among Sn—Ag plate solder, Sn—Ag cream solder, an epoxy resin containing Ag filler, an adhesive and a gold thin film. As a method of heating the electrode material, YAG laser of 25 W was adopted for the Sn—Ag plate solder, YAG laser of 25W was adopted for the Sn—Ag cream solder, a method of heating by infrared rays at 200° C. was adopted for the epoxy resin containing Ag filler, and YAG laser of 50W was adopted for gold.

Figure 5A:
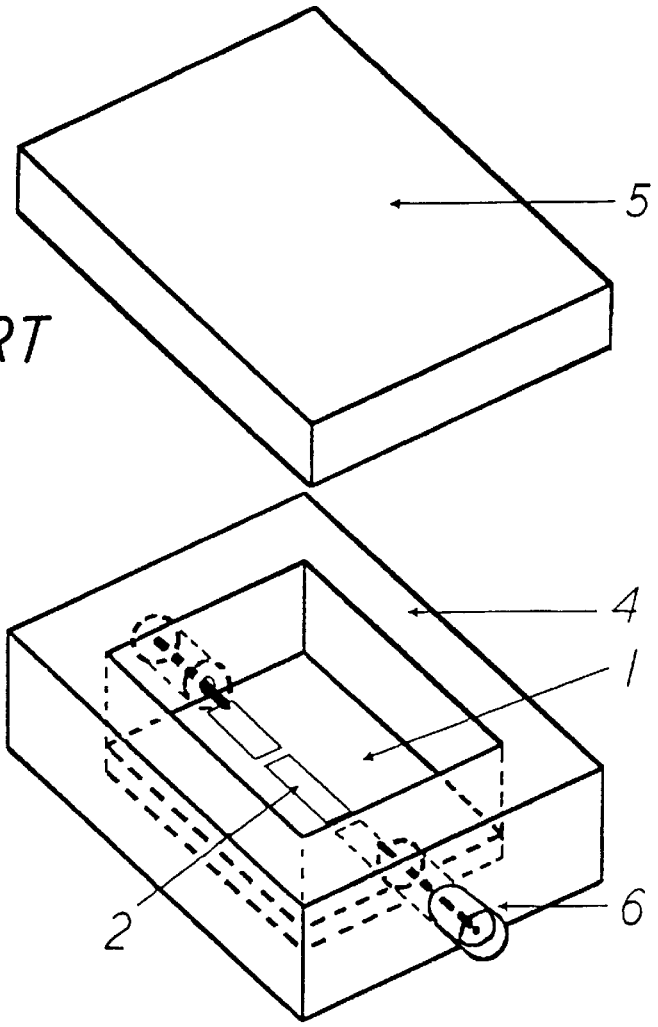
FIG. 5A PRIOR ART
FIG. 5A is an exploded perspective view showing an example of a conventional high-frequency electronic device.
Figure 5B:
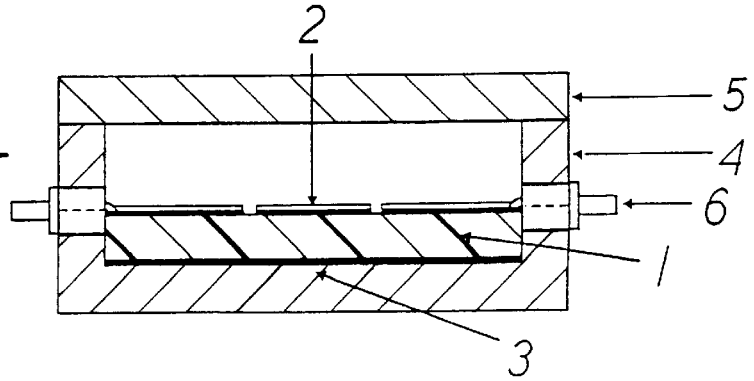
FIG. 5B PRIOR ART
FIG. 5B is a sectional view thereof.

It was possible to make these high-frequency electronic devices have total volumes of about 2.8 $cm^3$, which was considerably small, and it was possible to size down remarkably as compared with the high-frequency electronic device of the conventional configuration as shown in FIG. 5 having the same characteristic, whose total volume was about 18 $cm^3$ (excluding a coaxial cable connector).

With respect to the thus produced high-frequency electronic devices of the invention, the dielectric substrate was pulled at a pulling force of 0.2 $kg/mm^2$, and adhesion strengths of the respective connecting electrode portions to the dielectric substrates and adhesion strengths of the wiring conductor layers to each other at the connecting electrode portions were thereby evaluated, with the result that it was confirmed by using a tester to be used for a usual break check that the wiring conductor layers connected by the connecting electrode portions were electrically connected in every high-frequency electronic device, and it was demonstrated that they have an excellent adhesion strength.

Further, as a result of measuring loss at 2 GHz by using a network analyzer, a loss of 4 dB was obtained, and it is demonstrated to have excellent electric characteristics.

Still further, in the same manner, such a high-frequency electronic device of the invention was produced that a three-stage band pass filter which has-a characteristic impedance of 30 Ω was constructed as a high-frequency electronic circuit as well as a quarter-wavelength-type impedance transformer which has a wiring characteristic impedance of 38.7 Ω was constituted by the second wiring conductor layer, with the result that the loss was 3 dB in the measurement at 2 GHz using a network analyzer, and it was possible to reduce the loss of the filter by reducing the characteristic impedance of the band pass filter.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein, For instance, in lieu of a passive component such as a filter, an active component such as an amplifier may be mounted on the high-frequency electronic circuit Moreover, accompanying that, a structure of supplying power for an amplifier or the like may be added.

What is claimed is:

1. A high-frequency electronic device comprising:

a single-crystal dielectric substrate having a bottom face and a top face;

a first ground conductor layer formed on the bottom face of the single-crystal dielectric substrate;

a first wiring conductor layer constituting a high-frequency electronic circuit formed on the top face of the single-crystal dielectric substrate;

a first dielectric substrate having a bottom face and a top face;

a second ground conductor layer formed on the bottom face of the first dielectric substrate, the first dielectric substrate being in contact with the single-crystal dielectric substrate so that the top face of the first dielectric substrate forms substantially the same plane with the top face of the single-crystal dielectric substrate;

a second dielectric substrate having a top face and a bottom face;

a second wiring conductor layer formed on the top face of the first dielectric substrate or the bottom face of the second dielectric substrate; and a third ground conductor layer formed on the top face of the second dielectric substrate, wherein the second dielectric substrate is attached to the top faces of the single-crystal dielectric substrate and the first dielectric substrate so as to cover the top face of the single-crystal dielectric substrate and, wherein the first ground conductor layer is electrically connected with the second ground conductor layer and also electrically connected with the third ground conductor layer via a first through conductor disposed to pass through the first dielectric substrate and the second dielectric substrate and wherein the first wiring conductor layer is electrically connected with the second wiring conductor layer, and also electrically connectable with an external electric circuit via a second through conductor disposed to pass through the first dielectric substrate or the second dielectric substrate.

2. The high-frequency electronic device of claim 1, wherein the second wiring conductor layer constitutes an impedance transformer for matching in characteristic impedance the first wiring conductor layer to an external electric circuit connected with the second through conductor.

3. The high-frequency electronic device of claim 2, wherein the impedance transformer is of a quarter-wavelength type or taper type.

4. The high-frequency electronic device of claim 1, wherein the single-crystal dielectric substrate and the first and/or second dielectric substrate are different in dielectric constant.

5. A high-frequency electronic device according to claim 1, wherein at least a part of the bottom face of the second dielectric substrate is spaced a distance from the first wiring conductor provided on the single crystal dielectric substrate.

6. A high-frequency electronic device according to claim 1, wherein a part of the second wiring conductor layer provided on the bottom face of the second dielectric substrate overlaps a part of the first wiring provided on the single crystal dielectric substrate.

7. The high-frequency electronic device of claim 1, wherein at least one of the first ground conductor layer, the second ground conductor layer, the third ground conductor layer, the first wiring conductor layer and the second wiring conductor layer is formed of an orientation film, single-crystal film or superconducting thin film.

8. The high-frequency electronic device of claim 1, wherein the first wiring conductor layer and the second wiring conductor layer are electrically connected by a thermally-bonding-type conductive material.

9. The high-frequency electronic device of claim 1, wherein the first dielectric substrate and the second dielectric substrate are of the same crystalline structure as that of the single-crystal dielectric substrate.

10. The high-frequency electronic device of claim 1, wherein a coaxial cable connector is electrically connected to the second through conductor, and a conductive fixing member of the coaxial cable connector is used as the first through conductor.

11. A high-frequency electronic device comprising:

(a) a single-crystal dielectric substrate having a first ground conductor layer which is formed on one surface thereof and a first wiring conductor layer which is formed on the other surface thereof to constitute a high-frequency electronic circuit;

(b) a first dielectric substrate abutting against the single-crystal dielectric substrate so as to be next to each other, the first dielectric substrate having a second ground conductor layer which is formed on one surface thereof and electrically connected with the first ground conductor layer, the other surface of the first dielectric layer forming substantially the same plane with the other surface of the single-crystal dielectric substrate;

(c) a second dielectric substrate having a third ground conductor layer which is formed on one surface thereof and a second wiring conductor which is formed on the other surface thereof and electrically connected with the first wiring conductor layer, the second dielectric substrate being attached to the other surface of the single-crystal dielectric substrate and the other surface of the first dielectric substrate so as to cover the other surface of the single of the single-crystal dielectric substrate;

(d) a first through conductor passing through the first dielectric substrate and the second dielectric substrate, for electrically connecting the second ground conductor layer with the third ground conductor layer; and (e) a second through conductor passing through the second dielectric substrate and being electrically connected with the second wiring conductor layer to be electrically connected with an external electric circuit.

12. A high-frequency electronic device according to claim 11, wherein the first wiring conductor provided on the single crystal dielectric substrate is spaced a distance from the second dielectric substrate.

13. A high-frequency electronic device comprising:

(a) a single-crystal dielectric substrate having a first ground conductor layer which is formed on one surface thereof and a first wiring conductor layer which is formed on the other surface thereof to constitute a high-frequency electronic circuit;

(b) a first dielectric substrate abutting against the single-crystal dielectric substrate so as to be next to each other, the first dielectric substrate having a second ground conductor layer which is formed on one surface thereof and electrically connected with the first ground conductor layer, the other surface of the first dielectric substrate forming substantially the same plane with the other surface of the single-crystal dielectric substrate, the first dielectric substrate further having a second wiring conductor layer which is formed on the other surface of this first dielectric substrate;

(c) a second dielectric substrate having a third ground conductor layer which is formed on one surface thereof, the second dielectric substrate being attached to the other surface of the single-crystal dielectric substrate and the other surface of the first dielectric substrate so as to cover the other surface of the single-crystal dielectric substrate;

(d) a first through conductor passing through the first dielectric substrate and the second dielectric substrate, for electrically connecting the second ground conductor layer with the third ground conductor layer; and (e) a second through conductor passing through the first dielectric substrate, being electrically connected with the second wiring conductor layer to be electrically connected with an external electric circuit.

14. A high-frequency electronic device according to claim 13, wherein the first wiring conductor provided on the single crystal dielectric substrate is spaced a distance from the second dielectric substrate.

15. A high-frequency electronic device comprising:

(a) a first ground plane single-crystal substrate on one surface of which a first ground conductor layer is formed;

(b) a single-crystal dielectric substrate, one surface thereof facing the first ground conductor layer, the single-crystal dielectric substrate having a first wiring conductor layer which is formed on the other surface thereof to constitute a high-frequency electronic circuit;

(c) a first dielectric substrate abutting against the single-crystal dielectric substrate so as to be next to each other, the first dielectric substrate having a second ground conductor layer which is formed on one surface thereof and electrically connected with the first ground conductor layer, the other surface of the first dielectric substrate forming substantially the same plane with the other surface of the single-crystal dielectric substrate;

(d) a second dielectric substrate having a third ground conductor layer which is formed in a region corresponding to the first dielectric substrate of one surface thereof, and a second wiring conductor layer which is formed on the other surface thereof and electrically connected with the first wiring conductor layer, the second dielectric substrate being attached to the other surface of the single-crystal dielectric substrate and the other surface of the first dielectric substrate so as to cover the other surface of the single-crystal dielectric substrate,;

(e) a second ground plane single-crystal substrate having another third ground conductor layer which is formed in a region corresponding to the single-crystal dielectric substrate of a surface on the second dielectric substrate side and electrically connected with the third ground conductor layer;

(f) a first through conductor passing through the first dielectric substrate and the second dielectric substrate, for electrically connecting the second ground conductor layer with the third ground conductor layer; and (g) a second through conductor passing through the second dielectric substrate, being electrically connected with the second wiring conductor layer to be electrically connected with an external electric circuit.

16. A high-frequency electronic device according to claim 15, wherein at least a part of the bottom face of the second dielectric substrate is spaced a distance from the first wiring conductor provided on the single crystal dielectric substrate.

17. A high-frequency electronic device according to claim 15, wherein a part of the second wiring conductor layer provided on the bottom face of the second dielectric substrate overlaps a part of the first wiring provided on the single crystal dielectric substrate.

18. A high-frequency electronic device comprising:

a single-crystal dielectric substrate;

a first wiring conductor layer constituting a high-frequency electronic circuit formed on the single-crystal dielectric substrate;

at least one dielectric substrate disposed adjacent to the single-crystal dielectric substrate and defining at least one through hole;

a second wiring conductor layer formed on the at least one dielectric substrate and electrically connected to the first wiring conductor layer; and a through hole conductor that passes through the at least one through hole provided in the at least one dielectric substrate and connects to the second wiring conductor layer.

* * * * *